United States Patent [19]

Burleigh et al.

[11] Patent Number: 5,059,390

[45] Date of Patent: Oct. 22, 1991

[54] DUAL-PHASE, MAGNESIUM-BASED ALLOY HAVING IMPROVED PROPERTIES

[75] Inventors: T. David Burleigh; Rebecca K. Wyss, both of Plum Borough, Pa.

[73] Assignee: Aluminum Company of America, Pittsburgh, Pa.

[21] Appl. No.: 365,840

[22] Filed: Jun. 14, 1989

[51] Int. Cl.[5] ..... C22C 23/06; C22C 23/02

[52] U.S. Cl. ..... 420/405; 420/408; 420/409; 420/410

[58] Field of Search ..... 420/405, 407, 408, 409, 420/410

[56] References Cited

U.S. PATENT DOCUMENTS

| | | | |
|---|---|---|---|
| 2,011,613 | 8/1935 | Brown et al. | 29/181 |
| 2,305,825 | 12/1942 | Burkhardt et al. | 75/168 |
| 2,317,980 | 5/1943 | Dean et al. | 75/168 |
| 2,376,868 | 5/1945 | Dean et al. | 75/168 |
| 2,385,685 | 9/1945 | Busk | 75/168 |
| 2,453,444 | 11/1948 | Loonam | 75/168 |
| 2,507,714 | 5/1950 | Hesse | 75/168 |
| 2,604,396 | 7/1952 | Jessup | 75/168 |
| 2,622,049 | 12/1952 | Hesse | 148/21.9 |
| 2,961,359 | 11/1960 | Lillie | 148/13.1 |
| 3,039,868 | 6/1962 | Payne et al. | 75/168 |
| 3,119,684 | 1/1964 | Foerster | 420/408 |
| 3,119,689 | 1/1964 | Saia | 75/168 |
| 4,233,376 | 11/1980 | Atkinson et al. | 429/199 |

FOREIGN PATENT DOCUMENTS

| | | |
|---|---|---|
| 56-120293 | 9/1981 | Japan . |
| 258600 | 12/1969 | U.S.S.R. . |
| 328193 | 2/1972 | U.S.S.R. . |
| 455161 | 2/1975 | U.S.S.R. . |
| 485166 | 8/1976 | U.S.S.R. . |
| 559986 | 7/1977 | U.S.S.R. . |
| 569638 | 9/1977 | U.S.S.R. . |

OTHER PUBLICATIONS

"Electrochemical Behavior of Alloy MA-21 in Aqueous Solutions of Sodium Fluoride", *Zashchita Metallov (Protection of Metals)*, vol. 22 (1986).

*Primary Examiner*—Theodore Morris
*Assistant Examiner*—Robert R. Koehler
*Attorney, Agent, or Firm*—Gary P. Topolosky; Carl R. Lippert

[57] ABSTRACT

A dual-phase magnesium-based alloy consisting essentially of about 7–12% lithium, about 2–6% aluminum, about 0.1–2% rare earth metal, preferably scandium, up to about 2% zinc and up to about 1% manganese. The alloy exhibits improved combinations of strength, formability and/or corrosion resistance. There is also disclosed a composite matrix whose metal phase consists essentially of the aforementioned composition.

24 Claims, 3 Drawing Sheets

Hardness of the Artificially Aged Mg—Li Alloys

DUAL-PHASE, MAGNESIUM-BASED ALLOY HAVING IMPROVED PROPERTIES

BACKGROUND OF THE INVENTION

This invention relates to improved magnesium-based alloys suitable for aerospace applications. The alloys contain lithium and have a crystal structure with two or more phases. In as-cast, wrought or artificially aged forms, the Mg-Li alloys of this invention exhibit improved combinations of properties such as strength, formability and corrosion resistance. The invention further relates to composite structures containing an improved Mg-Li alloy.

It is generally known that magnesium-based alloys weigh less than some light metal counterparts. It is also known that minor additions of lithium improve the weight advantages of magnesium even further. As such, magnesium-lithium offers a viable alternative to aluminum and other light metal alloys for many aerospace applications. Generally, Mg alloys containing around 10% Li are about 45% less dense than aluminum and about 14% less dense than pure magnesium. Mg-Li alloys of this sort also exhibit better ductility and formability properties over more pure magnesium alloys. It is believed that this is due to the dual-phase crystal structure that forms with sufficient lithium addition, said structure exhibiting a hexagonal close packing (hcp) phase with a substantially continuous body-centered cubic (bcc) phase.

In Hesse U.S. Pat. No. 2,622,049, there is shown an age-hardened Mg alloy which includes lithium and at least one metal selected from 4–10% zinc, 4–24% cadmium, 0–12% silver and 4–12% aluminum. Lillie et al U.S. Pat. No. 2,961,359 discloses means for improving the high temperature strength of Mg-Li alloys by heat treating in a preferred atmosphere to convert substantially all lithium to lithium hydride.

Saia U.S. Pat. No. 3,119,689 discloses a Mg-based alloy which includes from 10.5 to 15% lithium, 1 to 3% silver, 1 to 1.5% aluminum, 1 to 1.5% zinc and from 0.1 to 2% silicon. After heat treating for 4 hours at 800° F., water quenching and aging for 24 hours at 225° F., this alloy possesses an ultimate tensile strength of 28 ksi and about 12% elongation.

In Atkinson et al U.S. Pat. No. 4,233,376, a battery anode composition is disclosed which consists of 6–12% lithium, up to 1.5% aluminum and impurities of less than about 0.2%. Japanese Patent Application No. 56/120,293 shows a speaker diaphragm made from a magnesium-based alloy containing 10 to 20% lithium, 0.1 to 1.5% zinc, 0.1 to 1% manganese with trace amounts of Zr, Si, Th and rare earth elements.

In Russia, apparently much research was conducted on magnesium-based alloys. Soviet Patent No. 258,600, for example, discloses a deformable Mg alloy containing 7–10% lithium, 4–6% aluminum, 3–5% cadmium, 0.8–2% zinc and 0.15–0.5% manganese. Later, this cadmium-containing alloy (designated MA-21) was criticized for having low corrosion stability under atmospheric conditions in an article entitled "Electrochemical Behavior of Alloy MA-21 in Aqueous Solutions of Sodium Fluoride", from *Zashchita Metallov* (*Protection of Metals*), Vol. 22 (1986).

Soviet Patent No. 455,161 increases the plasticity and "heat resistance" of magnesium-based alloys by adding 7–10% lithium, 0.5–1.5% yttrium, 0.05–0.2% aluminum and 0.05–0.2% manganese thereto. In Soviet Patent No. 485,166, there is claimed a corrosion-resistant Mg alloy which further includes 6–11% lithium, 1–6% aluminum, 3–5% cadmium, 0.5–2% zinc, 0.05–0.5% manganese and 0.05–0.15% rare earth metal.

Soviet Patent No. 559,986 claims another Mg alloy having high levels of lithium, particularly between 12–15%, with 0.5–3% aluminum, 0.05–0.2% manganese, 1.5–5% indium, and 0.005–0.5% chromium. In Soviet Patent No. 569,638, a magnesium-based alloy is claimed to be suitable for rockets, aircraft, space technology, instrument making and other structural materials. For improved foundry and corrosion resistance properties, this alloy contains 10.5–16% lithium, 1–3% zinc, 0.3–3% aluminum, 0.1–0.5% manganese, 0.1–1% scandium, 0.01–0.3% hafnium, 0.001–0.01% boron and at least one other metal selected from 0.05–0.4% neodymium and 0.1–0.3% cerium.

SUMMARY OF THE INVENTION

It is a principal objective of this invention to provide a strong, yet lightweight aerospace alloy. It is another objective to provide a formable magnesium-lithium alloy having high corrosion resistance when exposed to atmospheric conditions or accelerated corrosion tests. It is another objective to provide a dual-phase, Mg-Li alloy having room temperature yield strengths of at least about 25 ksi, for instance, about 28 ksi or more, said alloy resisting degradation at temperatures up to about 95° C. (200° F.) for several days, even up to one week or more. It is another objective to provide a Mg-Li alloy which is heat-treatable for improved hardening. With appropriate aging practices, the invention may achieve room temperature yield strengths of about 30, 35, or even 40 ksi. It is another objective to provide a lightweight Mg-based alloy which may be made into suitable aerospace structural members by casting, forging, extrusion, rolling or the like.

It is another main objective of this invention to provide magnesium-based alloys which do not require additions of cadmium or highly toxic elements to achieve improved property combinations. It is yet another objective to provide Mg-Li-containing composites with improved strength, formability and/or corrosion resistance. It is still another objective to provide Mg-based alloys which outperform in many respects those alloys mentioned hereinabove.

In accordance with the foregoing objectives and advantages, the improved alloy consists essentially of about 7–12% lithium, preferably about 8–10.5% Li; about 2–6% aluminum; about 0.1–2% rare earth metal, preferably scandium, though yttrium or cerium may be substituted therefor on a less preferred basis; up to about 1% manganese; up to about 2% zinc; the balance magnesium and incidental elements and impurities. For the invention alloys, combined Li and Al contents should be kept between about 11.5 and 15%, or more preferably between about 12.5 and 14.5%. For even greater strength, up to about 5% silicon may be added to the foregoing list of elements. Within these lithium ranges, the invention exhibits a mixture of body-centered cubic (bcc) and hexagonal close packing (hcp) crystal phase structures. A substantially cadmium-free aerospace structural member is also claimed to possess improved combinations of strength, formability and/or corrosion resistance. The foregoing alloy compositions are also suitable for metal matrix composites, especially those which combine light metals with silicon carbide cloth, fiber, particulates or the like.

BRIEF DESCRIPTION OF THE DRAWINGS

Other objectives and advantages of the invention will be made clearer from the following detailed description of preferred embodiments made with reference to the drawings in which.

DETAILED DESCRIPTION OF THE PREFERRED EMBODIMENTS

Figure 1:
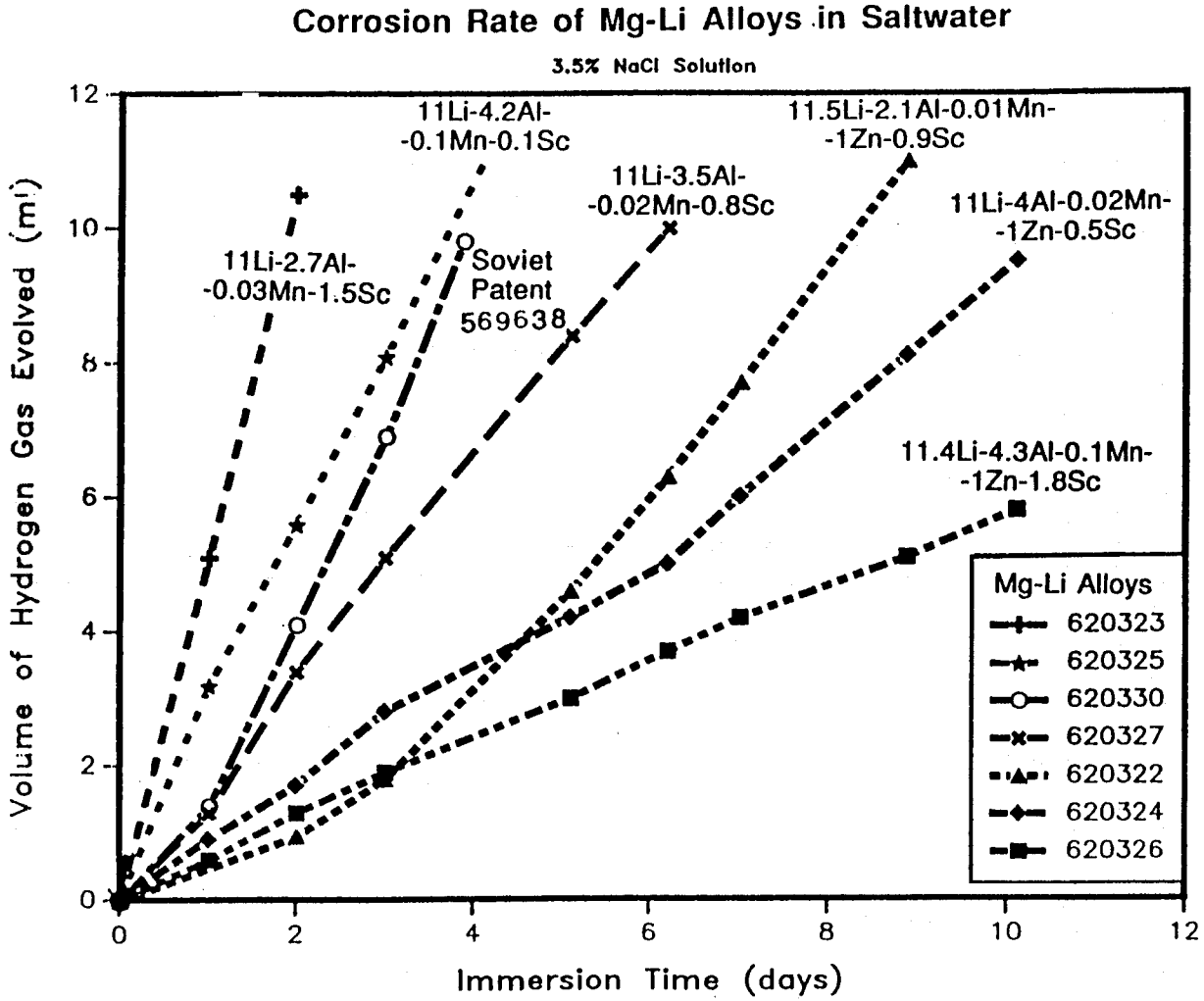
FIG. 1 is a graph comparing the number of days in which various Mg-Li alloy specimens were immersed in salt water solution versus the volume of hydrogen gas evolved.

With respect to this description of the present invention, the following interpretations apply:

A. Wherever compositions are described, reference is to weight percent (wt. %) unless otherwise indicated.

B. The term "formability" is the ability to roll, forge or otherwise form metal into one or more desired shapes.

C. The term "ingot-derived" means solidified from liquid metal by known or subsequently-developed casting processes, including direct chill casting, electromagnetic continuous casting and the like, rather than through powder metallurgy or rapid solidification techniques.

D. When numerical ranges are stated for any compositional element or alloy property, such ranges include each and every number, including fractions and/or decimals, from the range minimum to its stated maximum. (About 8 to 11% lithium, for example, also discloses 8.1, 8.2, . . . 9.8, 9.9, 10, . . . and so on, up to about 11% lithium.)

E. The term "substantially-free" means having no amount of a particular component purposefully added, it being understood that trace amounts of incidental elements and/or impurities may find their way into desired end product. For example, an alloy which is substantially Cd-free may contain less than about 0.2% cadmium, or less than about 0.05 or 0.03% cadmium on a more preferred basis.

F. The term "rare earth metal" means scandium (Sc), yttrium (Y) and the elements of the lanthanide series, namely: lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb) and lutetium (Lu).

The invention, which is especially pertinent to lightweighting applications in the aerospace industry, consists of a magnesium-based alloy containing moderate amounts of lithium to which has been added lesser amounts of aluminum, zinc, manganese and a rare earth metal, preferably scandium. For added strength, up to about 5% silicon may be combined therewith. Within the elemental ranges set forth below, the invention exhibits improved strength, formability and/or corrosion resistance properties in an as-cast, wrought or subsequently aged (i.e. heat treated) condition. Preferred embodiments consistently outperform an alloy representative of the Mg-Li alloy in Soviet Patent No. 569,638. The invention alloy produces room temperature yield strengths of about 25 ksi or more, said alloy resisting degradation at temperatures of about 95° C. (200° F.) for several days, up to about one week. Mg-Li alloy compositions of this invention also exhibit no galvanic corrosion when made into composites with silicon carbide cloth, fibers, particulates, or the like.

New alloy products in accordance with this invention contain at least about 7 or 7.5% lithium, or preferably about 8 or 8.5% to about 10 or 10.5% lithium. When such lithium levels are combined with preferred ranges of Al, Sc, Zn and Mn, a dual-phase crystal structure results, said structure serving to increase alloy formability, reduce density and reduce the rate of alloy corrosion in a salt water environment. Mg alloys containing from about 8.5 or 9% lithium, to about 11 or 11.5% lithium, are especially useful in the latter regard. Maximum lithium contents up to about 12% may also be beneficial, provided subsequent processing techniques (including heat treatments) take these slightly higher Li levels into account.

A principal objective of this invention provides Mg-Li alloys with a crystal structure having more than one phase, one of which is substantially continuous. Hence, preferred embodiments include about 7–12% lithium, or from about 8.5% to about 11.5% lithium. The dual-phase structure resulting from these elemental ranges is essentially body-centered cubic (bcc) and hexagonal close packing (hcp). In contrast, Mg alloys containing less than about 6% lithium exhibit only hcp characteristics while magnesium-based alloys with more than 12% lithium are primarily body centered cubic (bcc) in crystal phase structure.

To produce desired property combinations, it is also necessary for the invention to contain about 2–6% aluminum, or preferably less than about 4, 3.5 or even 3% Al. Aluminum levels of about 1.5 to 2.5%, or even 2 to 4.5%, are believed to be beneficial to alloy strength. In any event, total aluminum contents are proportionally related to the amount of lithium present such that preferred Li+Al levels range from about 11.5 to 14.5%, or more preferably, from about 12 or 12.5% to about 13.5, 14 or even 14.5%.

Greater property improvements are realized by adding still other elements to a ternary Mg-Li-Al alloy. For example, the invention should contain at least some rare earth metal, preferably scandium, in quantities above about 0.05 or 0.1% and below about 1.3, 1.5 or 2% to enhance alloy corrosion resistance. On a more preferred basis, maximum scandium levels of about 0.5 or 0.8% to about 1 or 1.3% are combined with the aforementioned lithium and aluminum levels. In scandium's absence, yttrium, cerium and other rare earth metals may be used as substitutes, though on a less preferred basis.

Zinc and manganese additions are also preferred, zinc being believed to provide a heat-treatable alloy with improved formability and strength, while further contributing to corrosion resistance. Manganese, on the other hand, is believed to impart improved corrosion resistance, perhaps, through impurity fluxing. Total zinc contents for the invention should be kept relatively low, preferably below about 1.5 or 2%, or more preferably between about 0.5 and 1.3% zinc. Total manganese contents should be kept even lower than that of zinc, although the invention may tolerate up to as much as 0.8 or 1% Mn. Manganese levels from about 0.1 to 0.5% have also proven to be especially beneficial.

Unlike many prior Mg-Li-Sc alloys, the preferred compositions of this invention are kept substantially free of boron, cadmium, hafnium, silver and sodium, for instance, fewer than about 0.05 or 0.1% of each element, or even less. Impurity levels for these alloys should also be maintained especially low to enhance their resistance to most corrosion effects. Total iron contents, for example, should be kept below about 0.07 or 0.1%, though better property combinations are imparted with still lower maximums of about 0.01, 0.03 or 0.05% iron. Total nickel contents should also be kept low, below about 0.05 or 0.07%, with nickel maximums below about 0.01 or 0.03% being even more preferred. Total copper contents should be kept under maximums of about 0.07 or 0.1% Cu. On a more preferred basis, Cu levels are kept below about 0.03 or 0.05%.

The invention alloys are formable using various techniques including rolling, forging, extruding or other known metalworking operations, to produce materials which are themselves shapable into aerospace structural members or the like. Accordingly, the invention may be worked into sheet, plate, extrusions, forgings, rods, bars, and numerous other configurations. In pre-shaped or end product form, these alloys exhibit improved combinations of strength, formability and/or corrosion resistance. Strength properties are especially enhanced by a magnesium alloy comprising about 8 to 9.5% lithium; greater than about 3% aluminum, i.e., about 3.5 to 5% Al; about 0.7% or more scandium, for example, about 0.9 to 1.2% Sc; about 0.8 to 1.2% zinc; and about 0.1 to 0.9% manganese. Greater resistance to corrosion is achieved in a magnesium alloy containing about 9.5 to 11.7% lithium; about 2.5 to 3.5% aluminum; about 0.2 to 1.2% scandium; about 0.8 to 1.2% zinc; and less than about 0.5% manganese. Enhanced formability (including forgeability), is achieved with magnesium-based alloys which further comprise about 10.5 to 12% lithium; about 1.5 to 2.5% aluminum; about 0.6 to 1.3% scandium; about 0.8 to 1.2% zinc; and less than about 0.2% manganese. In each of these embodiments, the levels of incidental elements and impurities are preferably kept low as described in greater detail above.

Strength levels for the aforementioned alloys may be further enhanced by adding up to about 5% silicon, or more preferably, between about 0.5 and 3 or 4% Si thereto. Yield strengths may also be improved through thermomechanical processing. Heat treating at about 345° C. (653° F.) for about one hour, for example, was observed to improve hardness levels by about 20 to 30% with no detriment to corrosion resistance. Still higher strength levels may be achieved by incorporating the alloys of this invention into a desired matrix composite. For example, when cast with compatible composite materials, such as silicon carbide cloth, fibers, particles or the like, the strength and abrasion resistance of end product should be enhanced with no detriment to corrosion resistance. In fact, substantially no galvanic attack was observed between cloth and metal after 1000 hours of salt water spraying a composite made from the aforementioned alloy and SiC material.

Comparative studies were conducted to determine the extent to which this invention outperforms known Mg-Li alloys, especially those containing scandium with higher levels of Li such as an alloy representative of Soviet Patent No. 569,638. The actual chemical compositions that were compared have been set forth in following Table 1.

TABLE 1

Chemical Analysis of the Alcoa Magnesium-Lithium Alloys
(All numbers are weight percent.)

| Sample Number | Mg | Li | Al | Sc | Zn | Mn | Other |
|---|---|---|---|---|---|---|---|
| 620016 | bal. | 10.90 | — | — | — | — | |
| 620017 | bal. | 10.70 | 3.12 | — | — | — | |
| 620018 | bal. | 10.50 | 3.18 | — | — | 0.81 | |
| 620019 | bal. | 10.80 | 3.15 | — | 1.13 | 0.67 | |
| 620020 | bal. | 11.00 | 3.00 | 0.46 | 1.14 | 0.27 | |
| 620021 | bal. | 10.60 | 3.04 | 0.43 | — | 0.07 | |
| 620112 | bal. | 10.50 | 3.05 | 0.64 | 1.06 | 0.07 | |
| 620113 | bal. | 10.80 | 3.20 | — | 1.08 | 0.25 | 0.59 Y |
| 620114 | bal. | 10.70 | 3.19 | — | 1.08 | 0.66 | 1.06 Ce |
| 620115 | bal. | 10.70 | 3.10 | 0.39 | 1.02 | 0.01 | |
| 620116 | bal. | 10.70 | 3.10 | 0.75 | 2.04 | 0.03 | |
| 620117 | bal. | 10.50 | 3.09 | 0.15 | 2.04 | 0.20 | |
| 620118 | bal. | 10.30 | 3.02 | 0.61 | 0.54 | 0.03 | |
| 620322 | bal. | 11.50 | 2.10 | 0.93 | 1.08 | 0.01 | |
| 620323 | bal. | 11.20 | 2.68 | 1.45 | — | 0.03 | |
| 620324 | bal. | 11.10 | 3.94 | 0.47 | 1.07 | 0.02 | |
| 620325 | bal. | 11.10 | 4.21 | 0.12 | — | 0.12 | |
| 620326 | bal. | 11.40 | 4.29 | 1.83 | 1.08 | 0.10 | |
| 620327 | bal. | 11.30 | 3.48 | 0.85 | — | 0.02 | |
| 620330 (Soviet Patent #569638) | bal. | 14.20 | 2.73 | 0.25 | 2.10 | 0.02 | <0.01 Hf, 0.22 Ce, <0.005 B |
| 620542 | bal. | 8.96 | 4.36 | — | 0.99 | 0.41 | |
| 620543 | bal. | 8.84 | 4.28 | 0.99 | 1.00 | 0.22 | |
| 620544 | bal. | 8.91 | 4.28 | 0.95 | 1.00 | 0.49 | |
| 620545 | bal. | 8.66 | 4.20 | 2.18 | 1.00 | 0.11 | |
| 620546 | bal. | 8.84 | 4.27 | 1.92 | 1.01 | 0.13 | |
| 620547 | bal. | 8.81 | 4.09 | 1.46 | 1.04 | 0.16 | SiC cloth |

bal. = balance
impurities of Fe, Cu and Ni <0.005

By referring to Table 1 and the accompanying Figures, it can be seen the extent to which the invention imparts improved property combinations. For FIG. 1, various specimens of polished Mg-Li alloys were coated with Miccromask® lacquer to expose a 1 $cm^2$ surface area before being placed in the bottom of a glass beaker containing 150 ml of 3.5% NaCl solution kept at room temperature. The volume of hydrogen gas evolved from each test specimen was then measured relative to its total immersion time to approximate actual corrosion rates. FIG. 1 then graphically illustrates how preferred embodiments of the invention corrode more slowly than Sample No. 620330, the specimen representing Soviet Patent No. 569,638.

Figure 2:
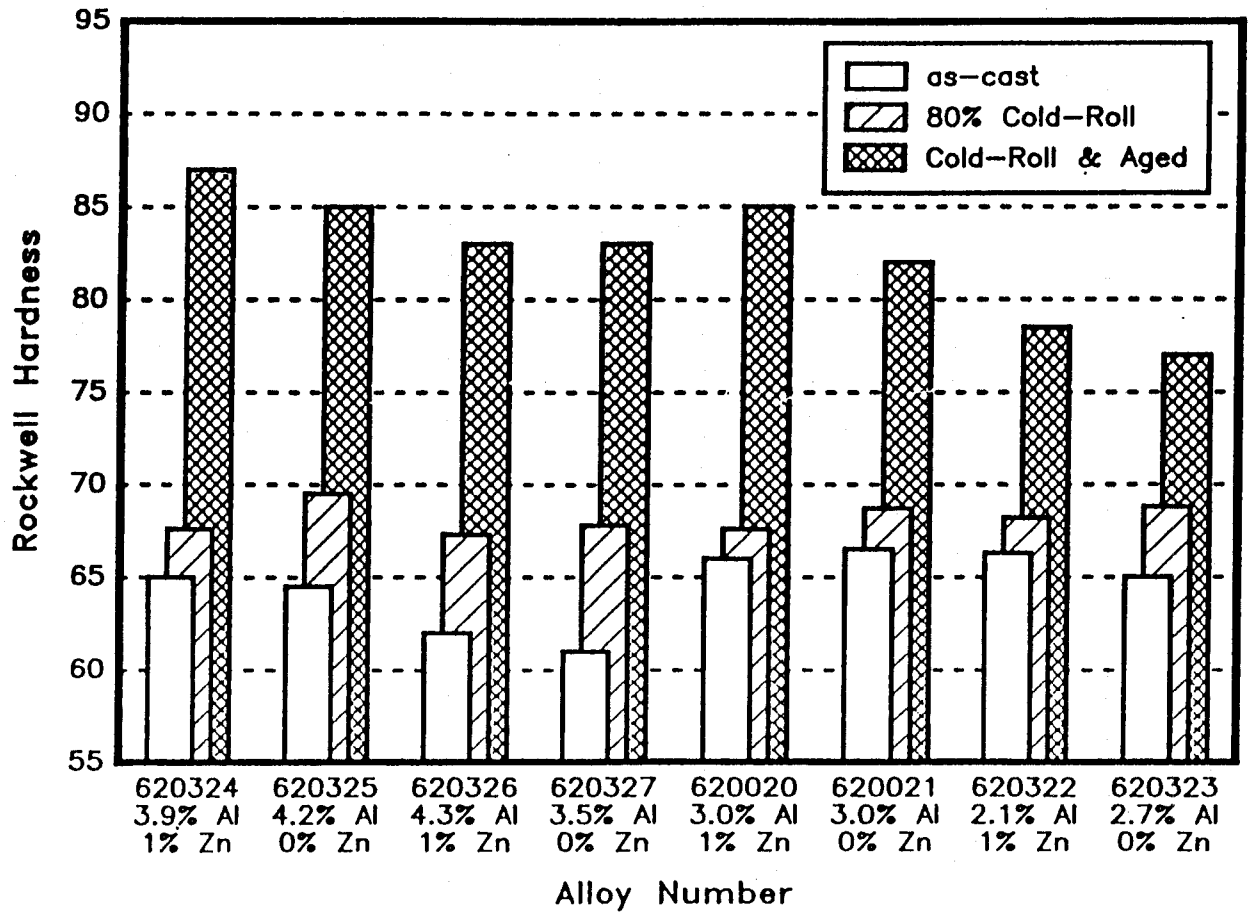
FIG. 2 is a graph comparing Rockwell Hardness values for various Mg-Li alloys in as-cast, 80% cold rolled, and artificially aged conditions.

In accompanying FIG. 2, hardness levels of various Mg-Li alloy samples were compared on a Rockwell R15T scale. For each sample number shown, as-cast hardness was plotted relative to 80% cold-rolled hardness and artificially aged hardness, the former being 80% cold rolled after three rolling passes and the latter achieved by heat treating for one hour at 345° C. (650° F.). From FIG. 2, it can be seen that Sample Nos. 620021 and 620322 possess the greatest as-cast hardness. At 80% cold rolled, Sample No. 620325 showed the highest relative hardness level. After thermal treatment under similar aging conditions, the measured hardness of Sample No. 620324 was greatest of those shown. The specimen representing Soviet Patent No. 569,638 (with 14% Li, 2.7% Al and a combined Li/Al content of 16.7%) was not included in the FIG. 2 comparison since this specimen cracked (or failed) during its first cold rolling pass. Such cracking (or failure) underscores a serious flaw in the representative Russian alloy, i.e., that it could not survive standard cold rolling practices, thereby diminishing its commercial value.

Figure 3:
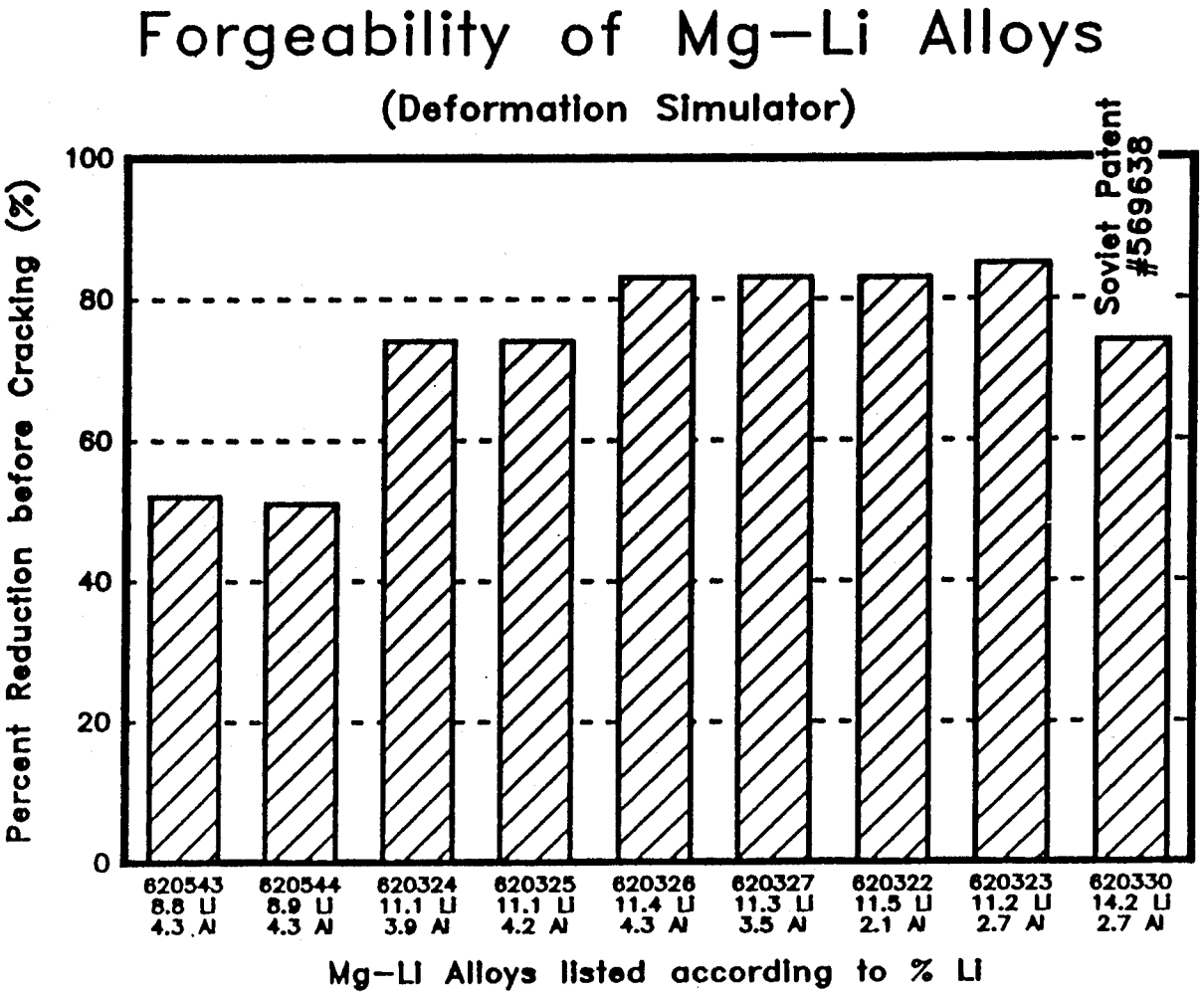
FIG. 3 is a graph comparing pre-cracking reduction percentages for various Mg-Li alloys.

In FIG. 3, forgeabilities of various Mg-Li alloys as measured on a deformation simulator were compared. From this comparison, it can be seen that Sample Nos. 620326, 620327, 620322 and 620323, showed greater percent reduction before cracking, especially when compared to an alloy representative of Soviet Patent No. 569,638, Sample No. 620330. Despite its high Li content, the patented Soviet alloy containing about 14% lithium showed relatively poor formability due to work hardening.

Having described the presently preferred embodiments, it is to be understood that the invention may be otherwise embodied within the scope of the appended claims.

What is claimed is:

1. An ingot-derived, cadmium-free alloy consisting essentially of: about 7–12 wt. % lithium; about 2–6 wt. % aluminum, the combined lithium and aluminum content being between about 12 and 14.5 wt. %; about 0.4–2 wt. % of an element selected from: scandium, yttrium, lanthanum, cerium, praseodymium, neodymium, promethium, samarium, europium, gadolinium, terbium, dysprosium, holmium, erbium, thulium, ytterbium and lutetium; up to about 2 wt. % zinc; up to about 1 wt. % manganese; the balance magnesium and impurities.

2. The alloy of claim 1 which contains about 8.5–10.5 wt. % lithium.

3. The alloy of claim 1 which has a hexagonal close packing (hcp) and body-centered cubic (bcc) crystal phase structure.

4. The alloy of claim 3 which maintains greater than 90% of its room temperature yield strength after exposure to elevated temperatures for about one week or more.

5. The alloy of claim 1 which contains: about 4 wt. % or less aluminum; about 1.5 wt. % or less of scandium, yttrium, cerium and combinations thereof; and about 0.1 to 0.5 wt. % manganese.

6. The alloy of claim 1 which contains about 1 wt. % or less scandium.

7. The alloy of claim 1 which further contains up to about 5 wt. % silicon.

8. The alloy of claim 1 which is free of boron, cadmium, hafnium, silver and sodium.

9. The alloy of claim 1 which contains less than about 0.1 wt. % total impurities, including up to about 0.05 wt. % iron, up to about 0.03 wt. % nickel and up to about 0.05 wt. % copper.

10. The alloy of claim 1 which contains less than about 0.05 wt. % total impurities, including up to about 0.01 wt. % iron, up to about 0.01 wt. % nickel and up to about 0.03 wt. % copper.

11. An ingot-derived, wrought alloy having an improved combination of properties, said alloy consisting essentially of: about 8 to 11.5 wt. % lithium; up to about 5 wt. % silicon; about 2 to 4.5 wt. % aluminum; about 0.5 to 2 wt. % of an element selected from scandium, yttrium and cerium; about 0.5 to 1.3 wt. % zinc; and about 0.05 to 0.7 wt. % manganese, the balance magnesium and impurities.

12. The wrought alloy of claim 11 which is cadmium-free and has a crystal structure that includes body-centered (bcc) and hexagonal close packing (hcp) phases.

13. The wrought alloy of claim 11 wherein the combined and aluminum content is between about 12 and 14.5 wt. %.

14. The wrought alloy of claim 11 which contains from about 0.5 to 3 wt. % silicon.

15. An aerospace structural member having an improved combination of strength and corrosion resistance, said structural member being made from an ingot-derived alloy consisting essentially of about 8.5 to 11.5 wt. % lithium; about 2 to 4.5 wt. % aluminum; about 0.5 to 2 wt. % scandium; about 0.8 to 1.3 wt. % zinc; up to about 0.7 wt. % manganese; said alloy having a total iron, nickel and copper content below about 0.05 wt. %, the balance magnesium and impurities.

16. The structural member of claim 15 whose alloy further contains up to about 5 wt. % silicon.

17. A magnesium-based alloy having improved strength, said alloy consisting essentially of about 8 to 9.5 wt. % lithium, about 3 to 6 wt. % aluminum, about 0.7 to 1.3 wt. % scandium, about 0.8 to 1.2 wt. % zinc and about 0.1 to 0.8 wt. % manganese, the balance magnesium and impurities.

18. The alloy of claim 17 which contains about 3.5 to 4.8 wt. % aluminum.

19. The alloy of claim 17 which further includes up to about 5 wt. % silicon.

20. A magnesium-based alloy having improved corrosion resistance properties, said alloy consisting essentially of about 9.5 to 11.7 wt. % lithium, about 2.5 to 3.5 wt. % aluminum, about 0.2 to 1.2 wt. % scandium, about 0.8 to 1.2 wt. % zinc and less than about 0.5 wt. % manganese, the balance magnesium and impurities.

21. The alloy of claim 20 which is free of boron, cadmium, hafnium, silver and sodium.

22. A magnesium-based alloy having a dual-phase crystal structure and improved formability, said alloy consisting essentially of about 10.5 to 12 wt. % lithium, about 1.5 to 2.5 wt. % aluminum, about 0.6 to 1.3 wt. % scandium, about 0.8 to 1.2 wt. % zinc and less than about 0.2 wt. % manganese, the balance magnesium and impurities.

23. The alloy of claim 22 which is free of boron, cadmium, hafnium, silver and sodium.

24. The alloy of claim 22 which further includes up to about 5 wt. % silicon.

* * * * *